United States Patent [19]

Davios et al.

[11] Patent Number: 4,718,498

[45] Date of Patent: Jan. 12, 1988

[54] AUTOMATIC TRIGGER MECHANISM FOR PORTABLE FIRE EXTINGUISHERS

[76] Inventors: Argiros Davios, Peloponneso 33, Petroupoli 132.31; Petros Davios, Markou Botsari, Petroupoli 132.31; Emmanuel Makridakes, Emm.Xanoto 15, Petroupoli 132.31, all of Athens, Greece

[21] Appl. No.: 897,764

[22] Filed: Aug. 18, 1986

[30] Foreign Application Priority Data

Apr. 23, 1986 [GR] Greece ..... 861076

[51] Int. Cl.[4] ..... A62C 35/12

[52] U.S. Cl. ..... 169/62; 169/60; 169/29; 337/395; 337/388; 251/129.2

[58] Field of Search ..... 169/51, 62, 29, 60, 169/61, 26, 19; 337/298, 382, 395, 399, 383, 393, 388, 392, 396, 397, 394; 116/101, 102; 251/129.2; 137/79; 340/577

[56] References Cited

U.S. PATENT DOCUMENTS

| | | | |
|---|---|---|---|
| 1,476,594 | 12/1923 | Conover | 169/29 |
| 3,387,662 | 6/1968 | Molgano, Jr. | 169/62 |
| 3,515,218 | 6/1970 | Gardner et al. | 169/62 |
| 4,276,939 | 7/1981 | Atack | 169/60 |

*Primary Examiner*—Joseph F. Peters, Jr.
*Assistant Examiner*—James M. Kannofsky
*Attorney, Agent, or Firm*—Browdy and Neimark

[57] ABSTRACT

A flame sensing device is connected to complete a circuit to supply current to an electromagnet to release fire extinguishing fluid to extinguish the flames. The flame sensing device includes a first spring which extends when heated, and a second spring in compression acting to pull an end of the first spring to close a contact to provide the current to the electromagnet.

7 Claims, 1 Drawing Figure

AUTOMATIC TRIGGER MECHANISM FOR PORTABLE FIRE EXTINGUISHERS

DESCRIPTION

FIELD OF THE INVENTION

SUMMARY OF THE INVENTION

The invention is based on an electro-mechanical mechanism which achieves the automatic triggering of portable fire extinguishers and the consequent discharge of fire extinguishing fluid towards the zone of fire.

The mechanism consists of an electromagnet which presses, with the aid of a bracket, the discharge valve of the fluid of the portable fire extinguisher which is connected to the mechanism. The fluid is discharged from the fire extinguisher via pipes when the electromagnet is energized by electric current which is supplied by the battery via a device which is sensitive to flames. This device, which is a separate invention and is used in conjunction with the present one, consists of a metal frame, within which extends a spring which when surrounded by flames expands and closes an electric circuit which then energizes the electromagnet.

With the triggering of the fire extinguisher, the fire extinguishing fluid is supplied via pipes at the probable areas of fire in order to achieve its extinguishing.

One practical application of the aforementioned automatic fire extinguishing mechanism, apart from its multiple uses, is its installation in cars for the protection of the engine against fire, as is explained later.

Up to now technology has not constructed such a device for the automatic triggering of portable fire extinguishers.

The invention can be industrially applied with various ways of construction. A sample of such a construction is presented on the description that follows.

DESCRIPTION OF THE PREFERRED EMBODIMENTS

Figure 1:
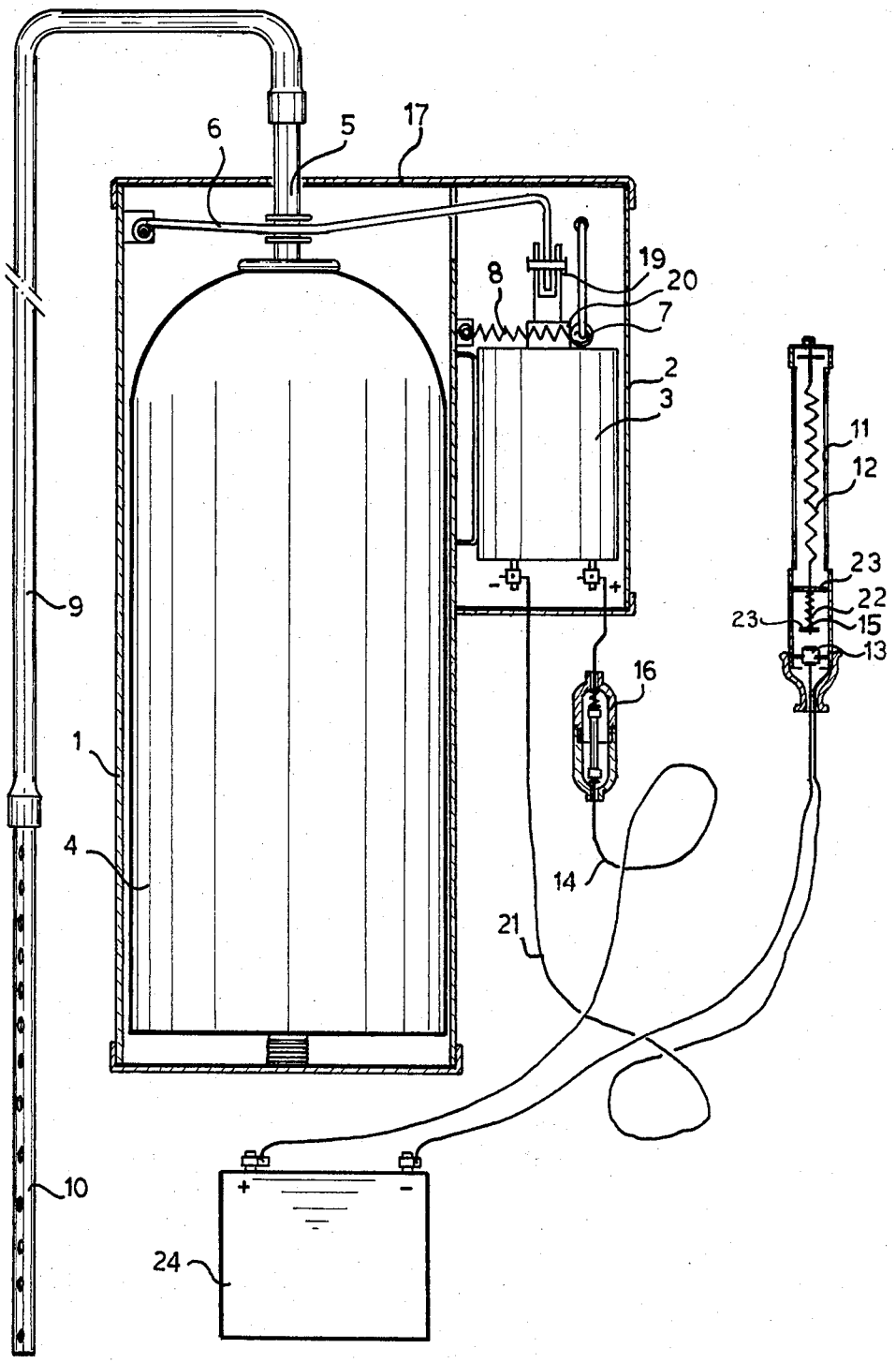
FIG. 1 shows a sectional view of an embodiment mechanism with its sensing device.

The main sections and parts of the invention are described on the basis of the indicative example below wherein the item numbering corresponds to the drawing.

The invented automatic triggering mechanism of portable fire extinghishers consists of case 1 which is covered by the cover 17, so that both the device 2 and the fire extinguisher 4 are protected from temperature, humidity, water, etc. and hence allowing the whole device to be placed in either open or closed spaces. Case 1 includes space for the installation of fire extinguisher 4 which is inserted from the side of plug 18, and is pressed firmly upwards with the spring that is situated inwards of plug 18. In the interior of the adjacent device 2, the electromagnet 3 is installed, whose moving bracket 19 carries a hole within which the end part of bracket 6 is inserted. When the bracket 19 is attracted by the electromagnet 3, bracket 6 presses the valve 5 and the fire extinguisher 4 discharges its fluid. In order to have continuous flow of the fluid, when bracket 19 is retracted at the interior of the electromagnet 3, the base 20 which supports bracket 19 is secured with pin 7, which is tensioned by spring 8. Thus there is continuous flow of fire extinguishing fluid. The securing of bracket

19, as is described above is necessary, because continuous supply of electric current to the electromagnet 3 is not possible. The reason for this is that such a continuous supply of current to the electromagnet 3 via cables 14 and 21 would cause their overheating and the electromagnet's function would cease. Hence while the electromagnet 3 is secured at the point of continuous attraction of bracket 6, with the aid of pin 7, the intermediate fuse 16 on conductor 14 is burned and the electric current supply is cut off.

The triggering of the electromagnet occurs with the aid of flame sensing device shown on the right of FIG. 1. This consists of casing 11 which can be of any shape (eg. solenoid or simple fork type etc.) at the interior of which extends a fine spring 12. At one end of spring 12 a pin 15 is attached, which is enclosed within two washers 23 which have a compressed spring 22 in between them. When the flame surrounds a part of spring 12, then this loses its elasticity and elongates so that spring 22 attracts downwards pin 15 which comes into contact with conductor 13 and hence the continuation of the circuit of the one pole of the battery occurs. Thus electric current flows via conductor 21 to the electromagnet 3 and energizes it. The positive conductor of current 14 is firmly connected with the electromagnet 3 and battery 24. With the triggering of the fire extinguisher 4, the fire extinguishing fluid is supplied via valve 5 to pipe 9, whose discharge tube 10, which for each particular use can have the most suited shape, carries holes from which the fire extinguishing fluid is discharged.

The mechanism can be installed at various sites which are in need of protection against fire. For example a car engine room area. The fire at a car engine is usually started at the carburator. In order to avoid the spreading of fire, the flame sensing device at the right of FIG. 1 is placed adjacent to the carburator which is surrounded by the end pipe 10 of appropriate shape so that when there is a fire, the flames will surround immediately the flame sensing device and the fire extinguishing fluid that will be discharged from discharge pipe 10 will spread over the entire engine room area. Of course it is possible to install other discharge pipes at other parts of the engine room area or the car, or even to install other sensing devices at other critical parts.

CONSTRUCTION AND FUNCTION

The invention at its application can have any desired shape, design and dimensions. FIG. 1 does not form a restricting design of this invention, but a mere indicative design without any particular scale of the plans.

We claim:

1. A device, comprising a tank containing a fire extinguishing fluid, a valve on said tank having a bracket connected thereto, for causing said fire extinguishing fluid to be released out of said tank via said valve when said bracket is moved, an electromagnet having a solenoid connected to an end of said bracket, for moving said bracket and releasing said fire extinguishing fluid when current is supplied to said electromagnet, and sensing means for detecting flames in the vicinity thereof, and for closing a circuit providing therewith for supplying said current to said electromagnet when said flames are detected by said sensing means, wherein said sensing means comprises a frame, a first spring fastened at a first end thereof to a first end of said frame, said first spring extending when heated by said flames in the vicinity thereof, and contact means for closing said circuit when said first spring is heated by said flames, including a pin connected at a second end of said first spring, and a second spring urging said pin to a position to close said circuit when said first spring extends due to said flames in the vicinity thereof.

2. The device of claim 1, wherein said frame supports a washer near said second end of said first spring, said second spring being located on the opposite side of said washer than said first spring, and being compressed between said washer and an end of said pin to pull said first spring to extend said first spring when said first spring is heated, to thereby close said circuit to provide said current to said electromagnet when said first spring has extended sufficiently as a result of being sufficiently heated by said flames.

3. The device of claim 1, comprising an end pipe connected to said valve for distributing said fire extinguishing fluid to extinguish said flames when said fire extinguishing fluid is released from said tank by said current being supplied to said electromagnet.

4. The device of claim 1, said circuit comprising a battery and a fuse connected in series with said electromagnet and said flame sensing means.

5. The device of claim 2, said circuit comprising a battery and a fuse connected in series with said electromagnet and said flame sensing means.

6. The device of claim 1, said first spring being in tension and said second spring being in compression.

7. The device of claim 2, said first spring being in tension and said second spring being in compression.

* * * * *